United States Patent [19]

Mulzet et al.

[11] Patent Number: 4,647,279

[45] Date of Patent: Mar. 3, 1987

[54] CENTRIFUGAL SEPARATOR

[75] Inventors: Alfred P. Mulzet, Charlotte, N.C.; Robert M. Kellogg, Boulder, Colo.

[73] Assignee: Cobe Laboratories, Inc., Lakewood, Colo.

[21] Appl. No.: 788,854

[22] Filed: Oct. 18, 1985

[51] Int. Cl.[4] ..... B04B 11/00

[52] U.S. Cl. ..... 494/45; 494/35

[58] Field of Search ..... 494/21, 18, 45, 16, 494/23, 35, 36, 81, 85, 43

[56] References Cited

U.S. PATENT DOCUMENTS

| | | | |
|---|---|---|---|
| 4,094,461 | 6/1978 | Kellogg et al. | 233/40 |
| 4,170,328 | 10/1979 | Kirk | 494/35 |
| 4,387,848 | 6/1983 | Kellogg | 494/45 |
| 4,430,072 | 2/1984 | Kellogg | 494/45 |
| 4,447,221 | 5/1984 | Mulzet | 494/45 |

*Primary Examiner*—Robert W. Jenkins

[57] ABSTRACT

A centrifugal separator comprising a circular centrifuge separation channel having an inlet for receiving a liquid to be separated and an outlet for providing components of the liquid in separated layers at different radial locations, a collection chamber for receiving the separated layers, the chamber having first, second and third outlets in the collection chamber for removing components at different radial locations in the chamber, the first and second collection tubes being joined together so that the combined flow of the two tubes flows in a combined collection tube, and pumps connected to receive liquid streams from the combined collection tube and the third collection tube, the pumps being located externally of, and not rotating with, the channel and collection chamber.

6 Claims, 6 Drawing Figures

CENTRIFUGAL SEPARATOR

FIELD OF THE INVENTION

The invention relates to a centrifugal separator of the type that continuously receives a stream of liquid to be separated and provides separated streams.

BACKGROUND OF THE INVENTION

In some centrifuges that continuously receive a stream of blood and provide separated streams of blood components, collection chambers have had three outlets, one for removing the heavy red blood cells at a radially outward position in the chamber, one for removing the lighter plasma at a radially inward position in the chamber, and one for removing the white blood cells and platelets of interest at the interface between the red cell layer and the plasma layer. The outlets are connected to respective pumps via tubing to a rotating seal or equivalent seal-less rotating tube structure.

In our U.S. Patent No. 4,094,461, which is hereby incorporated by reference, we disclosed a collection chamber in which a dam was placed behind the white cell outlet, to block flow past it of the white cell interface but permit flow of red cells and plasma; the plasma outlet was positioned behind the dam at generally the same radial position, as the interface outlet for the purpose of maintaining the interface position at the white cell outlet to provide efficient white cell removal. In a commercial embodiment of the device described in said patent, a four-channel rotating seal was used to connect the inlet tube and three collection tubes to three pumps.

SUMMARY OF THE INVENTION

We have discovered that by combining the flow of two collection tubes of a continuous centrifugal separator into a combined collection tube, we can very efficiently use the pumps to control flow rates in the tubes. This can permit the use of fewer pumps for a given number of tubes, to simplify the control operation, or can permit the use of an additional outlet in the collection chamber, to provide improved control of the removal of separated fractions.

In preferred embodiments there are four outlets, an interface outlet located at a radially intermediate position in front of a dam, a red cell outlet located at a radially outward position, a plasma outlet located at a radially inward position, and a separate interface outlet located at an intermediate interface position behind the dam, the tubes connected to the interface outlet and the red blood cell outlet being combined together. In such a structure, the separation channel can be automatically primed because all of the air is removed through the plasma outlet; the blood interface sets up quickly because the prime saline solution is removed through the plasma port, and the interface is more stable because the flow rate through the interface positioning outlet is reduced as compared to that in U.S. Patent No. 4,094,461.

Other advantages and features of the invention will be apparent from the following description of the preferred embodiment thereof and from the claims.

DESCRIPTION OF THE PREFERRED EMBODIMENT

The drawings will be described first.

Drawings

Structure

Figure 1:
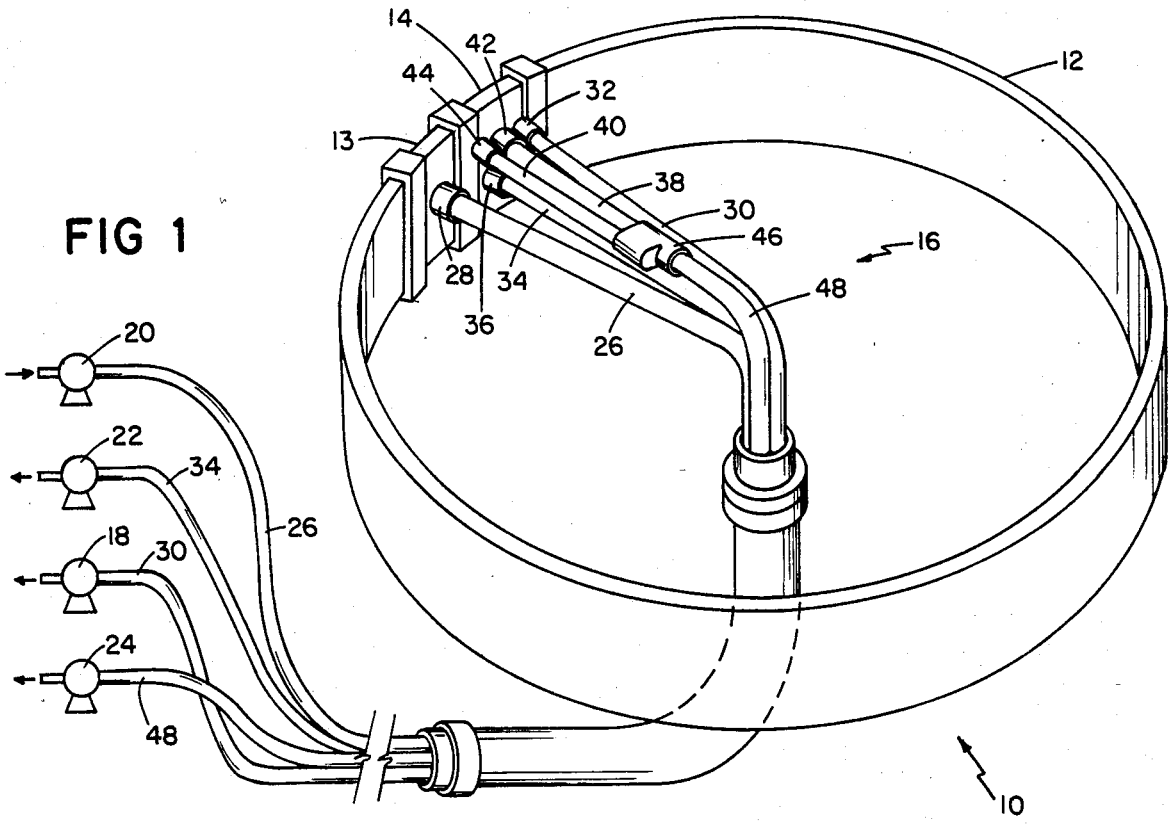
FIG. 1 is a diagrammatic perspective view of a centrifugal separator according to the invention.
Figure 2:
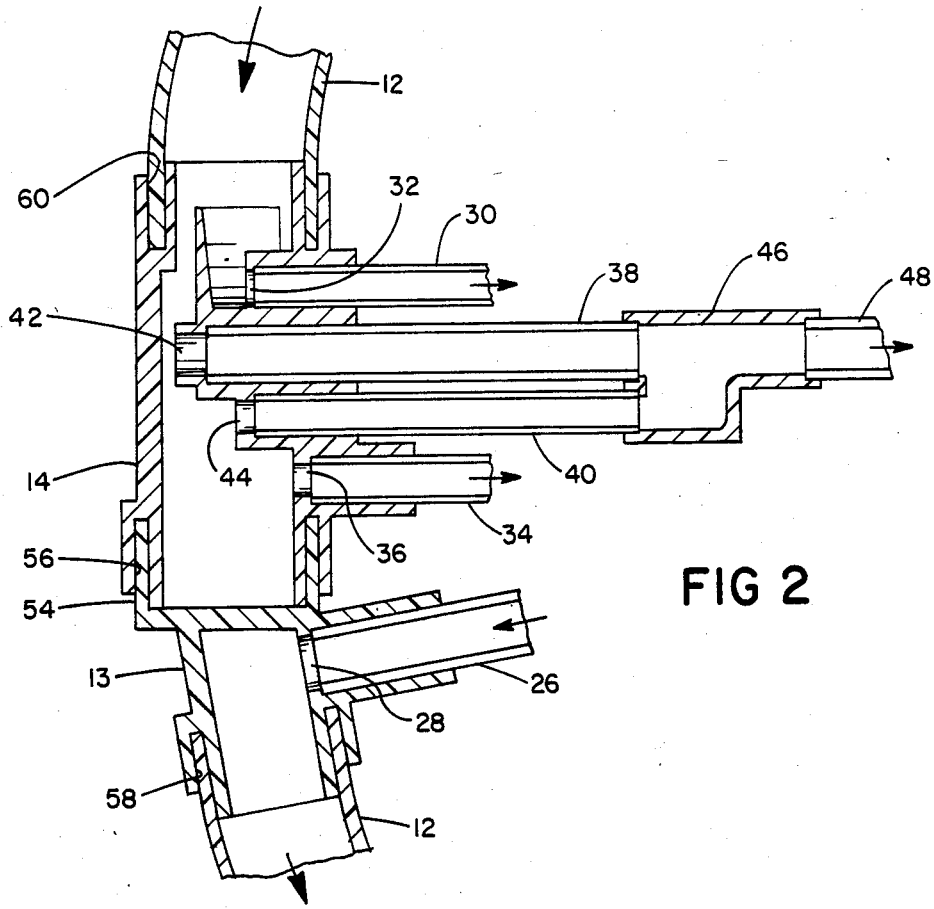
FIG. 2 is a sectional view of a collection chamber (with all four outlets diagrammatically shown in a row, to show relative radial positions) connected to an inlet chamber and a separation channel of the FIG. 1 apparatus.

Referring to FIGS. 1 and 2 there is shown centrifugal separator 10 including circular disposable centrifuge separation channel 12, inlet chamber 13, collection chamber 14, and input and collection tubes 16 connected to pumps 18, 20, 22, and 24 via a seal-less multichannel rotation connection means (not shown) of the well-known type shown, e.g., in U.S. Patent No. 4,146,172. Referring to FIGS. 1 and 2, tubes 16 include whole blood input tube 26 connected to inlet 28, white blood cell collection tube 30 connected to white cell collection outlet 32, plasma collection tube 34 connected to plasma collection outlet 36, red cell collection tube 38 connected to red cell collection outlet 42 and interface positioning collection tube 40 connected to interface positioning outlet 44. Tube 38 is 3.82" long and has an inner diameter of 0.094"; tube 40 is 3.74" long and has an inner diameter of 0.023", and tubes 38, 40 are joined at junction 46 to combined collection tube 48.

Figure 3:
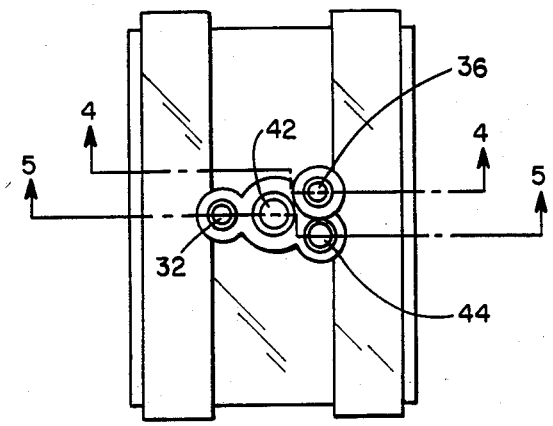
FIG. 3 is a plan view of said collection chamber.

Referring to FIG. 2, it is seen that inlet chamber 13 and collection chamber 14 are sealed to each other by the mating of extension 54 of inlet chamber 13 with slot 56 of collection chamber 14. Separation channel 12 is similarly sealed to inlet chamber 13 by mating with slot 58 of inlet chamber 13 and to collection chamber 14 at its opposite end by mating with slot 60 of collection chamber 14. In FIG. 2, plasma collection outlet 36 is shown diagrammatically closer to the end of collection chamber 14 than it is; its proper position, as shown in FIGS. 1 and 3, is next to interface positioning outlet 44.

Figure 6:
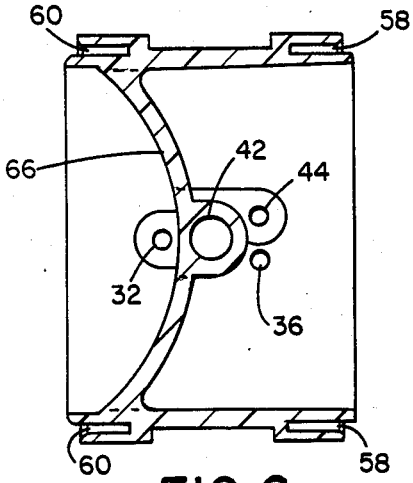
FIG. 6 is a horizontal sectional view, taken at 6—6 of FIG. 4, of said collection chamber.
Figure 4:
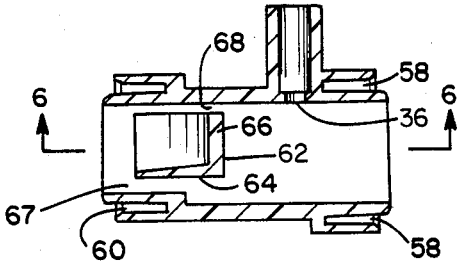
FIG. 4 is a vertical sectional view, taken at 4—4 of FIG. 3, of said collection chamber.
Figure 5:
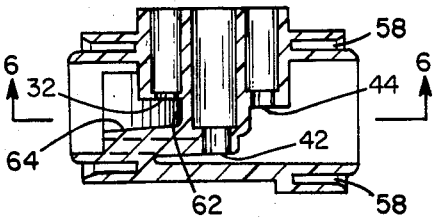
FIG. 5 is a vertical sectional view, taken at 5—5 of FIG. 3, of said collection chamber.

Referring to FIGS. 3–6, the structure of collection chamber piece 50 is shown in more detail. Referring to FIG. 4, it is seen that extending across collection chamber piece 50 is dam 62 having a horizontal piece 64 extending in the upstream direction and vertical piece 66 at the downstream end of it. As is seen in FIG. 5, white cell collection outlet 32 begins in front of vertical piece 66. Gap 67 is below horizontal piece 64 to permit the flow of red blood cells past dam 62, and a gap 68 is at the top of vertical piece 66 to permit the flow of plasma past dam 62. As is seen in FIG. 6, vertical piece 66 is curved in horizontal section with its most downstream portion just beyond white cell collection outlet 32.

Plasma outlet 34 is at the most radially inward position in collection chamber 14 (FIGS. 2, 4). Referring to FIGS. 2 and 5, it is seen that red cell collection outlet 42 is at the most radially outward position in chamber 14. White cell collection outlet 32 is about midway between the top and the bottom of dam 62. Interface positioning outlet 44 is slightly further outward than the radial position of white cell collection outlet 32.

OPERATION

In operation, separation channel 12 is supported by a rotating bowl (not shown), e.g., like that that shown in U.S. Patent No. 4,094,461, and whole blood is supplied by inlet tube 26 to inlet 28 of inlet chamber 13. The whole blood travels through separation channel 12 and is subjected to centrifugal forces, resulting in stratification of the blood components. The components delivered to collection chamber 14 are thus stratified, the red blood cell components being at the most radially outward position, the plasma being located at the most radially inward position and the white blood cells and platelets being located at the interface between the two.

In collection chamber 14 the interface is located at white cell collection outlet 32 and is directed by dam 62 to outlet 32 where the white cells and platelets are removed and pumped by pump 18. The red blood cells travel through gap 67 and are removed at red cell collection outlet 42, and the plasma travels through gap 68 and is removed at plasma collection outlet 34. The white cells and platelets are prevented from moving to outlet 44 by dam 62.

Behind dam 62, interface positioning outlet 44 removes the desired amount of plasma and red cells necessary to maintain the interface at about the position of outlet 32. Red cells in collection line 38 and the red cells and plasma in interface positioning tube 40 are joined together at junction 46 and are removed by combined collection tube 48. The sum of the flows through interface positioning outlet 44 and red cell collection outlet 42 is controlled by pump 24. The diameter of red cell collection tube 38, which conveys the dense, viscous red blood cells, is greater than that of interface positioning tube 40, to permit relatively unrestricted flow through it of the red blood cells.

If the interface at outlet 44 moves radially inward, the red cell component begins to flow through tube 40, but at a reduced flow rate, because the red cell component is more viscous than the plasma component. This reduced flow causes the plasma component to increase, pushing the interface radially outward back to the proper position. Similarly, if the interface moves radially outward from outlet 44, the less viscous plasma component flows through outlet 44, and the plasma will relatively quickly flow through it, causing the interface to return to the position of outlet 44.

By having plasma collection outlet 36 at the radially most inward position and separate from the interface positioning outlet, many advantages are realized. For example, channel 12 can be automatically primed and more quickly primed, because all air leaves through plasma outlet 36. The interface is very stable because the volume of flow through interface positioning outlet 44 is small. Fewer platelets are removed with the plasma and lost in plasma exchange, because plasma outlet 36 is remote from the cellular elements.

By combining two tubes 38, 40 at junction 46 and using combined collection tube 48, the number of tubes that must go through the seal-less rotation connection mechanism is still kept at four, and the number of pumps is still four. This is very advantageous, because it provides the improved interface control without increasing the number of pumps and the number of channels in the seal-less rotation connection mechanism.

OTHER EMBODIMENTS

Other embodiments in the invention are within the scope of the following claims.

For example, four pumps are not needed for the one-inlet, three-outlet arrangment shown in FIG. 1. Instead one could have one inlet pump and two outlet pumps, or three outlet pumps; in each case the flow through the unpumped inlet or outlet would be determined by the flow rates of the other three. Also, in addition to, or instead of, making tube 40 smaller in diameter than tube 38, flow could be made more restricted in tube 40 than in tube 38 by making tube 40 longer than tube 38.

What is claimed is:

1. A centrifugal separator comprising a circular centrifuge separation channel having an inlet for receiving a liquid to be separated and an outlet for providing components of said liquid in separated layers at different radial locations, an inlet tube for delivering said liquid to be separated to said inlet, a collection chamber for receiving said separated layers, said collection chamber having first, second and third outlets for removing components at different locations in said chamber, first, second and third collection tubes connected to said first, second and third outlets respectively, said first and second collection tubes being joined together so that the combined flow of said two tubes flows in a combined collection tube, and two pumps connected to control flow rates in said inlet tube, said combined collection tube and said third collection tube, said pumps being located externally of, and not rotating with, said separation channel and collection chamber, whereby a single pump can be used to remove liquid from and second outlets.

2. The separator of claim 1 wherein said first and second collection tubes and at least a portion of said combined collection tube are adapted to rotate with said separation channel and collection chamber and further comprising multichannel means for conveying liquid in said combined collection tube and said third collection tube to said pumps, whereby joining the streams of said first and said outlets upstream of said multichannel means reduces the number of channels of said multichannel means.

3. The separator of claim 2 wherein said third outlet is at a radially intermediate position in said collection chamber, and further comprising a dam behind said third collection outlet, said dam blocking flow past it at a radially intermediate position in said chamber, but permitting flow at radially inward and outward positions.

4. The separator of claim 3 further comprising a fourth collection tube connected to a fourth collection outlet positioned at a radially inward position, and wherein said first outlet is located at a radially outward position, and said second outlet is located a radially intermediate position behind said dam, said first outlet being a red cell outlet, said second outlet being an interface positioning outlet, said third outlet being a white cell collection outlet, and said fourth outlet being a plasma outlet.

5. The separator of claim 4 wherein said second collection tube is smaller in diameter than said first collection tube so as to restrict flow through it of the denser, more viscous component at radially outward positions.

6. The separator of claim 4 wherein said second collection tube is longer in length than said first collection tube.

* * * * *